US007081081B2

(12) United States Patent
Schütz et al.

(10) Patent No.: US 7,081,081 B2
(45) Date of Patent: Jul. 25, 2006

(54) BAYONET COUPLING MECHANISM FOR A CENTRIFUGE

(75) Inventors: Klaus Schütz, Waldeck (DE); Raymond Gary Potter, Southbury, CT (US)

(73) Assignee: Kendro Laboratory Products, LP, Newton, CT (US)

( * ) Notice: Subject to any disclaimer, the term of this patent is extended or adjusted under 35 U.S.C. 154(b) by 269 days.

(21) Appl. No.: 10/419,265

(22) Filed: Apr. 21, 2003

(65) Prior Publication Data

US 2004/0018928 A1 Jan. 29, 2004

Related U.S. Application Data

(60) Provisional application No. 60/374,123, filed on Apr. 22, 2002.

(51) Int. Cl.
*B04B 7/06* (2006.01)

(52) U.S. Cl. ..... 494/12; 403/349

(58) Field of Classification Search ..... 494/12, 494/16, 20, 33, 64, 84, 85; 210/232; 403/348–349
See application file for complete search history.

(56) References Cited

U.S. PATENT DOCUMENTS

| | | | | | |
|---|---|---|---|---|---|
| 2,865,662 | A | * | 12/1958 | Nurmse | 242/318 |
| 3,028,075 | A | * | 4/1962 | Blum | 494/20 |
| 3,819,111 | A | * | 6/1974 | Romanauskas et al. | 494/16 |
| 3,843,045 | A | * | 10/1974 | Schmidt et al. | 494/27 |
| 3,961,745 | A | * | 6/1976 | Wright | 494/9 |
| 4,010,890 | A | * | 3/1977 | Wright | 494/37 |
| 4,101,070 | A | * | 7/1978 | Hoare et al. | 494/9 |
| 4,344,563 | A | * | 8/1982 | Romanauskas | 494/20 |
| 4,360,151 | A | * | 11/1982 | Cowell et al. | 494/10 |
| 4,412,830 | A | * | 11/1983 | Strain et al. | 494/12 |
| 4,435,169 | A | * | 3/1984 | Romanauskas | 494/20 |
| 4,753,631 | A | * | 6/1988 | Romanauskas | 494/9 |
| 4,850,951 | A | * | 7/1989 | Cheng et al. | 494/16 |
| 5,344,380 | A | * | 9/1994 | Chern et al. | 494/12 |
| 5,411,465 | A | * | 5/1995 | Glen et al. | 494/16 |
| 5,443,438 | A | * | 8/1995 | Wright et al. | 494/84 |
| 5,456,653 | A | * | 10/1995 | Wright | 494/82 |
| 5,512,030 | A | * | 4/1996 | Barkus | 494/16 |
| 5,558,616 | A | * | 9/1996 | Barkus et al. | 494/12 |
| 5,681,257 | A | * | 10/1997 | Letourneur | 494/12 |
| 5,897,482 | A | * | 4/1999 | Lowe | 494/12 |
| 6,056,684 | A | * | 5/2000 | Linder et al. | 494/12 |
| 6,063,018 | A | * | 5/2000 | Letourneur | 494/12 |
| 6,149,570 | A | * | 11/2000 | Lowe et al. | 494/12 |
| 6,665,924 | B1 | * | 12/2003 | Schutz | 29/525.11 |
| 6,764,438 | B1 | * | 7/2004 | Potter | 494/12 |
| 6,776,751 | B1 | * | 8/2004 | Potter | 494/12 |
| 6,802,803 | B1 | * | 10/2004 | Potter | 494/12 |
| 2003/0144124 | A1 | * | 7/2003 | Schutz | 494/12 |
| 2003/0199380 | A1 | * | 10/2003 | Potter | 494/12 |
| 2003/0199381 | A1 | * | 10/2003 | Potter | 494/12 |
| 2004/0018928 | A1 | * | 1/2004 | Schutz et al. | 494/12 |

(Continued)

FOREIGN PATENT DOCUMENTS

DE 3334655 A1 * 4/1985

(Continued)

*Primary Examiner*—Charles E. Cooley
(74) *Attorney, Agent, or Firm*—Baker & Hostetler LLP

(57) ABSTRACT

A centrifuge having a motor shaft, a rotor that engages the motor shaft and a cover for securing the rotor to the rotor shaft. The cover has a knob with a coupling disposed therein. The coupling functions to simultaneously secure the rotor cover to the rotor body and the rotor body to the motor shaft.

7 Claims, 4 Drawing Sheets

U.S. PATENT DOCUMENTS

| | | | | |
|---|---|---|---|---|
| 2004/0220037 | A1* | 11/2004 | Potter | 494/12 |
| 2004/0224831 | A1* | 11/2004 | Potter | 494/12 |
| 2004/0229742 | A1* | 11/2004 | Potter | 494/12 |

FOREIGN PATENT DOCUMENTS

| | | | |
|---|---|---|---|
| DE | 3805894 C1 | * | 3/1989 |
| DE | 3805896 C1 | * | 3/1989 |
| JP | 58-6257 | * | 1/1983 |
| JP | 7-284695 | * | 10/1995 |
| JP | 7-284696 | * | 10/1995 |
| JP | 7-328486 | * | 12/1995 |
| JP | 10-216562 | * | 8/1998 |
| JP | 2002-86017 | * | 3/2005 |
| JP | 2001-205136 | * | 7/2005 |
| WO | 83/04379 | * | 12/1983 |

* cited by examiner

BAYONET COUPLING MECHANISM FOR A CENTRIFUGE

PRIORITY

This application claims priority to the provisional U.S. patent application entitled, EASY ACCESS COVER, filed Apr. 22, 2002, having a Ser. No. 60/374,123, the disclosure of which is hereby incorporated by reference.

FIELD OF THE INVENTION

The present invention relates generally to centrifuges, and more specifically to a centrifuge cover in which a rotor tighten-down device and a cover tighten-down device are integrated into a single locking mechanism.

BACKGROUND OF THE INVENTION

A centrifuge is a device by which a liquid sample may be subjected to a centrifugal force, thereby separating the sample into constituent components based on the density of each component. A centrifuge rotor is a component of a centrifuge device that is adapted to hold tubes filled with the liquid sample. A centrifuge motor shaft transmits a drive torque from a motor to the rotor; thus spinning the rotor at high rotational speeds to achieve the centrifugal force required to separate the sample into its constituent components. A rotor cover when secured to the rotor provides an aerodynamic, smooth surface that reduces air friction during operation and/or it may provide a bio-containment seal if a sample leaks from a tube.

Due to the force and speed generated by the centrifuge motor, it is critical that the rotor be securely coupled to the motor shaft and the cover to the rotor prior to operation of the centrifuge in order to avoid damage to the rotor, the cover and to the centrifuge. Current locking mechanisms require a user, prior to loading or unloading a rotor, to tighten or loosen two separate screw mechanisms. The first screw mechanism is a cover tighten-down screw that locks the rotor cover to the rotor body. The second screw mechanism is a rotor tighten-down screw that locks the rotor body to the rotor shaft. Damage to the machine may result if either screw is not properly tightened. A need therefore exists for a device that easily secures the rotor cover and rotor body to the motor shaft.

SUMMARY OF THE INVENTION

A centrifuge having a motor shaft, a rotor that engages the motor shaft and a cover for securing the rotor to the rotor shaft. The cover has a knob with a coupling disposed therein. The coupling functions to simultaneously secure the rotor cover to the rotor body and the rotor body to the motor shaft.

In particular, a unique rotor cover locking device that integrates the functions of a rotor tighten-down screw and a cover tighten-down screw into a single locking mechanism, which is an integral part of a rotor cover knob.

In accordance with an embodiment of the present invention, a centrifuge assembly is provide that includes a rotor, a shaft, housing containing therein the rotor and the shaft, and a cover disposed about one end of the housing. The rotor is disposed between the cover and the shaft. A coupler assembly secures both the cover to the rotor and the rotor to the shaft.

In accordance with another embodiment of the present invention, a centrifuge is provided having a rotor and a shaft.

The centrifuge also includes a rotor body adapter housing that engages the rotor and it also includes a rotor hold down shaft. The centrifuge further includes a coupling assembly and a cover with a knob wherein the coupling secures the cover to the rotor and the rotor to the motor shaft.

In accordance with yet another embodiment of the present invention, a centrifuge is provided having a motor shaft and a rotor that engages the motor shaft along with a coupling assembly. The centrifuge also includes a cover having a knob, wherein the knob has an a top surface and an indicator disposed within said knob. The knob also has a knob pin contained therein that engages the coupling assembly and secures the cover to the rotor. The indicator is flush with the top surface when the rotor is secured to the motor shaft. The indicator projects above the top surface when the rotor is released for the motor shaft.

In accordance with another embodiment of the present invention, an attachment and release apparatus for use with a centrifuge having a rotor and a motor shaft is provided. The apparatus includes a knob having a passage therethrough along with a cover disposed around the knob. The apparatus also has an indicator pin slidably disposed within the passage. The indicator pin has a first end and a second end and a first axial slot. The apparatus further includes a knob pin disposed with said first axial slot and an adapter removably connected to the rotor. The apparatus additionally includes a hours with a second axial slot. The housing has a coupling assembly for coupling the cover to the rotor and for coupling the rotor to the motor shaft. The apparatus includes a shaft with a first end and a second end disposed in the adapter, wherein the shaft has a hole at the first end. The apparatus also includes a first biasing element disposed within the passage and a second biasing element disposed within the housing.

In accordance with yet another embodiment of the present invention, a method for attaching and releasing a rotor to a motor shaft and attaching and releasing a rotor cover to the rotor is provided, comprising the steps of: attaching the rotor to the motor shaft; attaching the rotor cover to the rotor, wherein the rotor cover includes a knob connected thereto; rotating the knob in a first direction, wherein said step of rotating attaches the rotor body to the motor shaft and attaches the rotor cover to the rotor body via coupling assembly which secures both the cover to the rotor and the rotor to the rotor shaft.

In accordance with still another embodiment of the present invention, a centrifuge is provided having a motor shaft and a rotor that engages the rotor shaft. The centrifuge also includes a rotor hold down shaft. The centrifuge also includes a rotor body drive adapter housing that the hold down shaft slidably engages. The apparatus further includes cover having a knob with a top surface. The cover also includes a knob pin and an indicator disposed within the knob. The knob pin connects the cover to the rotor. The indicator is in a first position relative to the top surface when the cover is secured to the rotor and the rotor is secure to the motor shaft. The indicator is in a second position relative to the top surface when the rotor is detached from the motor shaft.

In accordance with another embodiment of the present invention, an attachment and release apparatus for use with a centrifuge having a rotor and a motor shaft, is provided. The apparatus includes a means for attaching the rotor to the motor shaft and for attaching a rotor cover to the rotor. The apparatus further includes a means for rotating said means for attaching, wherein said means fro rotating is connected to the cover.

In accordance with still another embodiment of the present invention, a centrifuge is provided having a motor shaft and a rotor that engages the motor shaft. The centrifuge also includes a cover having a knob with a top surface. An indicator is disposed within knob wherein the indicator is in a first position relative to the top surface when the rotor is secured to the motor shaft. The indicator is in a second position relative to the top surface with the rotor is released form the motor shaft.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The foregoing and still other objects and advantages of the present invention will be more apparent from the following detailed explanation of the preferred embodiments of the invention in connection with the accompanying drawings.

DETAILED DESCRIPTION OF PREFERRED EMBODIMENTS OF THE INVENTION

Figure 1:
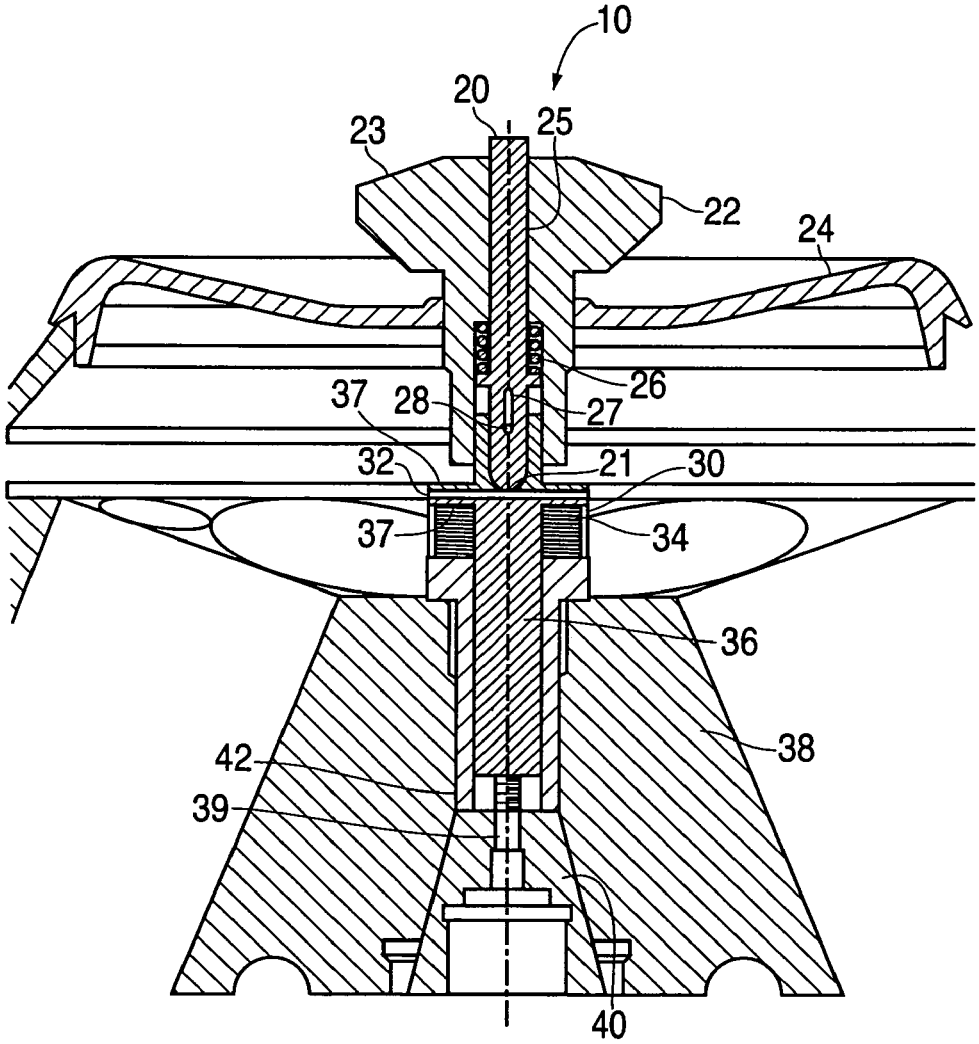
FIG. 1 illustrates a side plan cross-sectional view of a centrifuge cover assembly with rotor tighten-down indicator in the unlocked position.

The present invention can best be described by reference to the attached figures, wherein FIG. 1 is a side plan cross-sectional view of a centrifuge cover assembly in the unlocked position. The centrifuge according to the present invention, generally represented by reference numeral 10, includes a motor shaft 40, a rotor body 38 and a rotor cover 24.

Rotor body 38 houses a shaft pin 32, a rotor drive adapter 42, an outer housing 30, having biasing elements 34 such as bevel spring washers, disposed therein, and a rotor hold down shaft 36. Rotor hold down shaft 36 has a flanged end 37 and a threaded end 39. Rotor cover 24 includes a rotor knob 22 with a top surface 23 and having a inner bore or channel 25, a rotor tighten-down indicator pin 20 with a tapered end 21, a knob pin 28 disposed in the lower portion of rotor tighten-down indicator pin 20, and a biasing element, such as coil spring 26.

Figure 2:
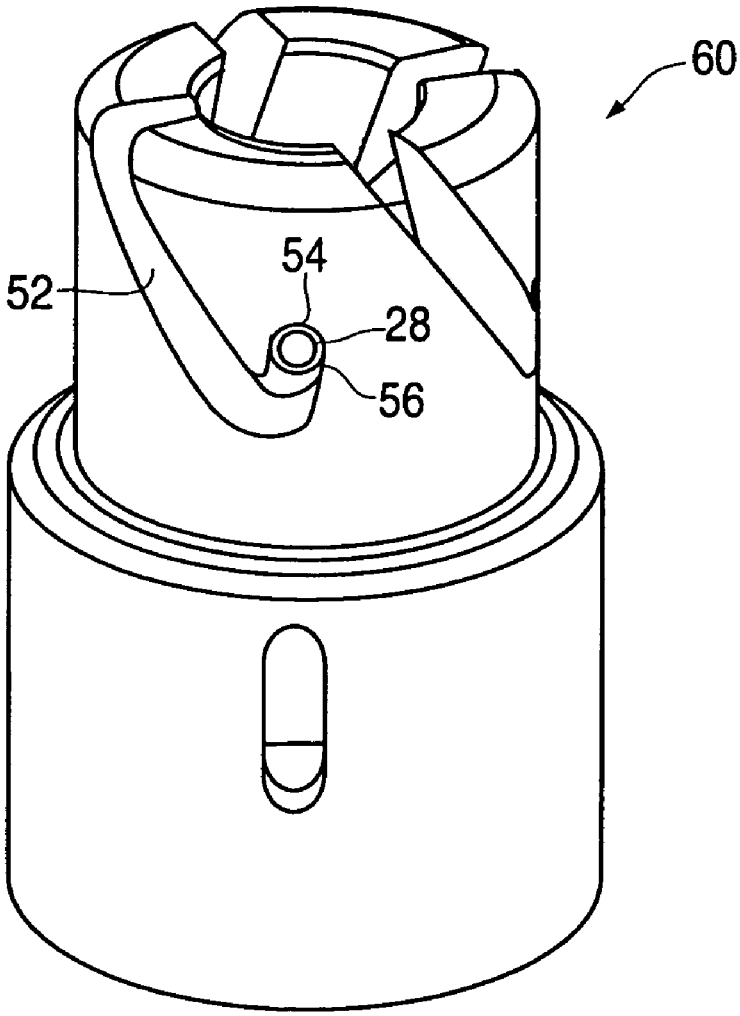
FIG. 2 illustrates a perspective view of a bayonet screw and knob pin coupling.

Rotor body 38 is secured to motor shaft 40, and rotor cover 24 is secured to rotor body 38 by a unique locking mechanism that integrates the functions of a rotor tighten-down screw and a cover tighten-down screw into a quick and efficient locking mechanism. The locking mechanism functions via a unique coupling or bayonet screw 60 represented in FIG. 2. The bayonet screw 60 functions by providing the means to lock the cover 24 to the rotor 38 and transmits rotation to the bayonet screw 60, to lock the rotor 38 to the motor shaft 40. As depicted in FIG. 2, the knob pin 28 engages the bayonet screw 60. Bayonet screw 60 includes an angled slot 52 and an axial slot 54. Axial slot 54 has a straight edge 56.

Figure 3:
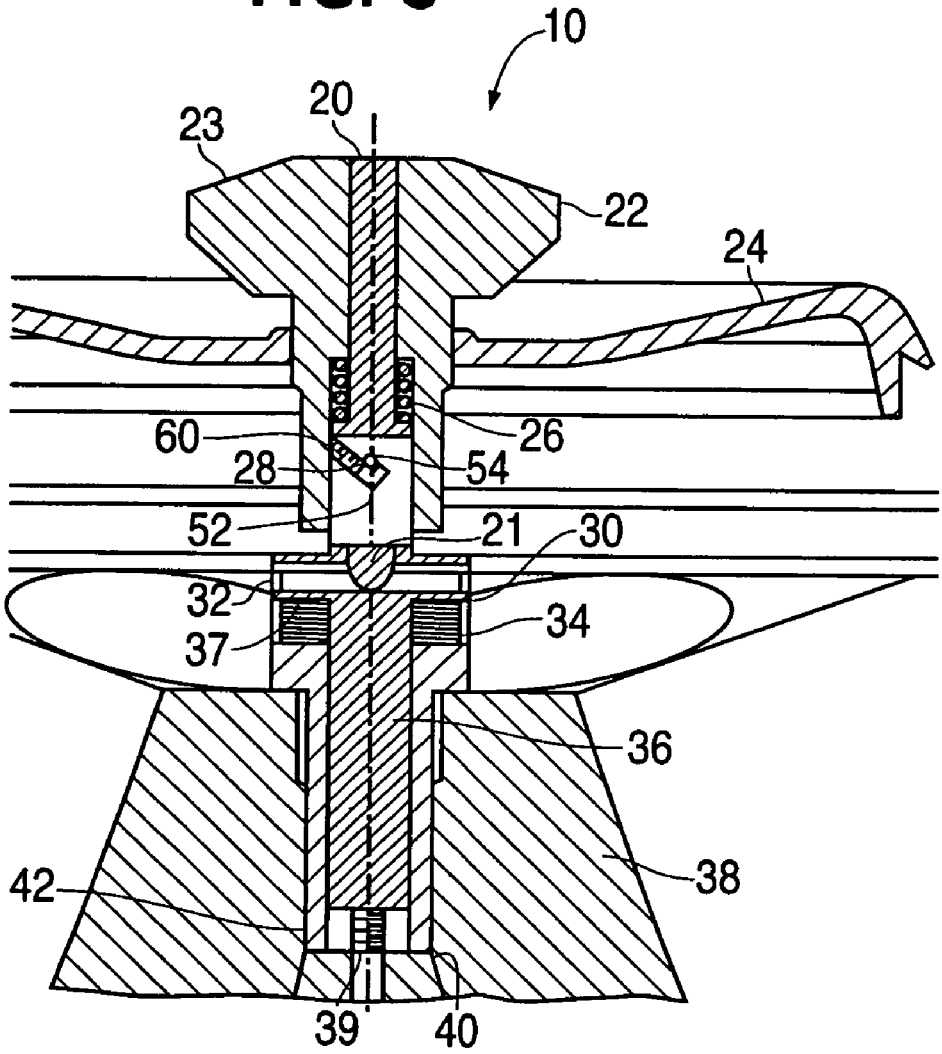
FIG. 3 illustrates a side plan cross-sectional view of a centrifuge cover rotor knob engaged in the bayonet screw of illustrated in FIG. 2.
Figure 4:
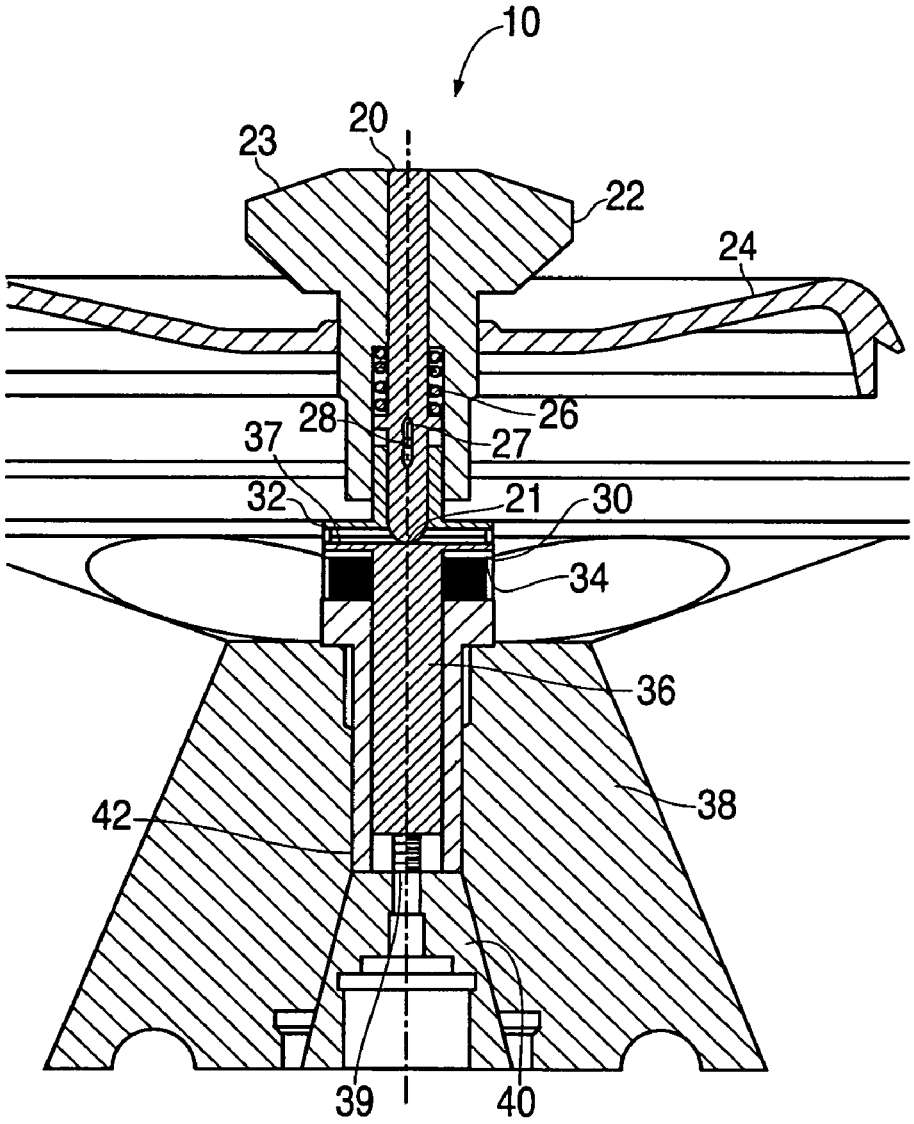
FIG. 4 illustrates a side plan cross-sectional view of a centrifuge cover assembly with rotor tighten-down indicator in the locked position.

Referring now to FIGS. 2–4, knob pin 28 is disposed within a radial hole in the knob 22 and also is slidably within an axial groove 27 in the lower portion of rotor tighten-down indicator pin 20. Bayonet screw 60 is situated within the smaller diameter of the knob 22. In operation, a counterclockwise turn of knob 22, and, concurrently, knob pin 28, moves knob pin 28 in a downward direction through angled slot 52 of bayonet screw 60. Also, in the locked position, spring 26 retains knob pin 28 in axial slot 54 by pushing upward against the knob 22 as depicted in FIG. 3. In the locked position, rotor tighten-down indicator pin 20 is pressed by the spring 26 upon the top surface of the flange of the rotor hold down shaft 36. As the threaded end 39 of the rotor hold down shaft 36 "tightens down" or screws into the motor shaft 40, it pulls down or draws the rotor hold down shaft 36 down towards the motor shaft 40 until it stops upon abutting or contacting the motor shaft 40. Preferably, the threaded end 39 of the rotor hold down shaft 36 has a left handed thread, however a threaded end having a right handed thread may also be employed. As the rotor hold down shaft translates downward, the flanged end 37 compresses the bevel springs 34, allowing the indicator pin 20 to translate downward, until the indicator pin 20 is flush with the top surface 23 of knob 22.

Although the bayonet screw 60 is described in combination with the knob 22, it is a separate coupling mechanism or component, as depicted in FIG. 2. The bayonet screw 60 is connected to the rotor hold down shaft 36 by the shaft pin 32. The bayonet screw 60 may be connected to, or disposed within, the knob 22 prior to operation as previously described, or it may be connected to the rotor 38 prior to operation. Similarly, the bayonet screw 60 in the outer housing 30 and the rotor hold down shaft 36 is described in combination with the rotor 38 and the adapter housing 42, however the rotor hold down assembly shaft 36 may be connected to the knob 22 prior to operation. In this orientation, the rotor hold down assembly is inserted into the adapter 42 and rotated via the knob 22, screwing the threaded end 39 of the shaft 36 into the motor shaft 40.

Referring again to FIG. 1, assembly of centrifuge 10 is accomplished by first placing the rotor body 38 on the motor shaft 40 and then attaching rotor cover 24 to the motor shaft 40. Rotor body 38 is locked to motor shaft 40 by turning rotor knob 22 in a counterclockwise direction. The counterclockwise movement of knob 22 through knob pin 28, causes outer housing 30 to move the shaft pin 32, thereby moving rotor hold-down shaft 36 to engage the motor shaft 40. The aforementioned movement causes the outer housing 30 to contact the rotor drive adapter 42, thereby causing flanged end 37 of rotor hold-down shaft 36 to compress or preload bevel spring washers 34. The counterclockwise turn further threads threaded end 39 of rotor hold-down shaft 36 into motor shaft 40.

Referring again to FIG. 3, as rotor knob 22 is turned, the rotor knob 22 moves downward as the knob pin 28 moves downward through angled slot 52 of bayonet screw 60 and then upward into straight slot 54, forming a locked position. Simultaneously, the counterclockwise turning further compresses spring 26, which in turn exerts pressure on the knob 22 that causes the knob pin 28 to be maintained in axial slot 54, as depicted in FIG. 2

Referring to FIG. 4, torque is transferred from knob pin 28 to axial slot 54 during the counterclockwise rotation of the knob 22. Torque is also transferred from rotor knob 22 to outer housing 30 during rotation and thereby to the rotor hold down shaft 36 by the shaft pin 32. Thus, torque is transferred simultaneously to lock both rotor body 38 to the motor shaft 40 and the rotor cover to the rotor 38.

The aforementioned torque screws the threaded end 39 of the rotor hold down shaft 36 into the motor shaft 40. As this occurs the indicator pin 20 follows the rotor hold down shaft 36, causing the indicator pin 20 to become flush with the top surface 23 of the knob 22, indicating that the rotor body 38 is successfully secured to the motor shaft 40, as shown in FIG. 4. Additionally, rotor tighten-down indicator pin 20 remains in contact with flanged end 37 of rotor hold down shaft 36, and bevel spring washers 34 are compressed to preload rotor body 38 to rotor shaft 40.

Referring now to FIGS. 1–4, rotor cover 24 is disengaged from rotor body 38 by first pushing rotor knob 22 downward towards rotor body 38, thereby compressing coil spring 26 and disengaging knob pin 28 from axial slot 54, of bayonet screw 60 within the smaller diameter of the knob 22. Next, the turning of rotor knob 22 clockwise, fully releases knob pin 28 from axial slot 54, driving knob pin 28 upward along angled slot 52. At this stage, the rotor cover 24 is in an unlocked position and rotor cover 24 can be lifted from rotor body 38. The rotor body 38 remains locked to the motor shaft 40.

Rotor body 38 may be disengaged together with rotor cover 24 from motor shaft 40 by turning rotor knob 22 in the clockwise direction without pushing down the rotor knob 22, until rotor hold down shaft 36 is disengaged from motor shaft 40. As shown in FIG. 1, rotor tighten-down indicator pin 20 projects above top surface 23 of rotor knob 22 when unlocked, indicating that rotor body 38 is disengaged from motor shaft 40. Bevel spring washers 34 are in an unloaded position when the centrifuge is unlocked. At this stage, rotor cover 24 can be lifted from rotor body 38, and rotor body 38 can be lifted from motor shaft 40.

The present invention has been described with particular reference to the preferred embodiments. It should be understood that the foregoing descriptions and examples are only illustrative of the invention. Various alternatives and modifications thereof can be devised by those skilled in the art without departing from the spirit and scope of the present invention. Accordingly, the present invention is intended to embrace all such alternatives, modifications, and variations that fall within the scope of the appended claims.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An attachment and release apparatus for use with a centrifuge having a rotor and a motor shaft, comprising:
- a knob having a passage therethrough;
- a cover disposed around said knob;
- an indicator pin slidably disposed within said passage of said knob, said indicator pin having a first end and a second end and an axial slot within said knob;
- a knob pin disposed within said axial slot;
- an adapter removably connected to the rotor;
- a housing with a second axial slot that includes a coupling assembly for coupling said cover to the rotor and for coupling the rotor to the motor shaft;
- a shaft having a first end and a second end slidably disposed within said adapter, wherein said shaft has a hole located at said first end;
- a shaft pin disposed within said hole of said shaft and disposed within said housing slot;
- a first biasing element disposed within said passage of said knob; and
- a second biasing element disposed within said housing.

2. The attachment and release apparatus according to claim 1, wherein said coupling assembly comprises a bayonet screw.

3. The attachment and release apparatus according claim 2, wherein said bayonet screw further comprises an angled slot.

4. The attachment and release apparatus according claim 2, wherein said bayonet screw further comprises an axial slot.

5. The attachment and release apparatus according to claim 1, wherein said first end of said shaft is a flange and engages said second end of said indicator pin.

6. The attachment and release apparatus according to claim 5, wherein said second biasing element extends between said adapter and said flange and wherein said second biasing element is a spring.

7. The attachment and release apparatus according to claim 1, wherein said first biasing element is a spring.

* * * * *